US008653727B2

(12) United States Patent
Li et al.

(10) Patent No.: US 8,653,727 B2
(45) Date of Patent: Feb. 18, 2014

(54) HID LIGHTING ASSEMBLY CAPABLE OF INSTANT ON/OFF CYCLE OPERATION

(75) Inventors: Jianwu Li, Solon, OH (US); Laszlo Balazs, Godollo (HU)

(73) Assignee: General Electric Compan, Schenectady, NY (US)

( * ) Notice: Subject to any disclaimer, the term of this patent is extended or adjusted under 35 U.S.C. 154(b) by 84 days.

(21) Appl. No.: 12/266,919

(22) Filed: Nov. 7, 2008

(65) Prior Publication Data

US 2010/0117509 A1 May 13, 2010

(51) Int. Cl.
*H01J 17/30* (2006.01)

(52) U.S. Cl.
USPC ..... 313/323; 313/324; 313/567

(58) Field of Classification Search
USPC ..... 313/323, 324, 567
See application file for complete search history.

(56) References Cited

U.S. PATENT DOCUMENTS

| | | | | |
|---|---|---|---|---|
| 3,732,460 | A | | 5/1973 | Wattenbach |
| 4,323,824 | A | | 4/1982 | Roche et al. |
| 4,668,204 | A | | 5/1987 | English et al. |
| 4,680,509 | A | | 7/1987 | Fallier et al. |
| 4,795,945 | A | | 1/1989 | Mayer |
| 4,910,432 | A | | 3/1990 | Brown et al. |
| 5,298,837 | A | | 3/1994 | Diestl |
| 5,394,062 | A | | 2/1995 | Minarczyk et al. |
| 5,444,334 | A | | 8/1995 | Speaker et al. |
| 5,449,980 | A | | 9/1995 | Kiefer et al. |
| 5,512,801 | A | * | 4/1996 | Nilssen ..... 315/209 R |
| 5,594,308 | A | | 1/1997 | Nuckolls et al. |
| 5,595,438 | A | * | 1/1997 | Burd ..... 362/228 |
| 5,914,571 | A | | 6/1999 | Beasley |
| 5,986,413 | A | | 11/1999 | Zijlman |
| 6,072,286 | A | | 6/2000 | Sears |
| 6,091,208 | A | | 7/2000 | Flory |
| 6,111,359 | A | * | 8/2000 | Work et al. ..... 315/56 |
| 6,323,604 | B1 | | 11/2001 | Boenigk et al. |
| 2002/0101164 | A1 | | 8/2002 | Yan |
| 2002/0171527 | A1 | | 11/2002 | Minami et al. |
| 2003/0222588 | A1 | * | 12/2003 | Myron et al. ..... 315/159 |
| 2004/0219839 | A1 | | 11/2004 | Faust et al. |
| 2007/0126371 | A1 | * | 6/2007 | Brates et al. ..... 315/291 |

FOREIGN PATENT DOCUMENTS

| | | | |
|---|---|---|---|
| EP | 1 206 169 | A2 | 5/2002 |
| GB | 2 203 302 | A | 10/1988 |
| WO | WO 2006/079937 | A1 | 8/2006 |

* cited by examiner

*Primary Examiner* — Nimeshkumar Patel
*Assistant Examiner* — Christopher Raabe
(74) *Attorney, Agent, or Firm* — Fay Sharpe LLP

(57) ABSTRACT

A high intensity discharge lighting assembly capable of instant ON/OFF operation with a lamp housing having therein an HID lamp, an instant ON igniter circuit and lamp driver circuitry. The housing may have a screw in base or may be configured for fixed mounting on an open receptacle box. In one version, a non-replaceable HID lamp has leads permanently connected to the instant ON circuitry. In another version, the HID lamp has an integral base with pins which are plugged in to a socket provided in the housing.

24 Claims, 7 Drawing Sheets

HID LIGHTING ASSEMBLY CAPABLE OF INSTANT ON/OFF CYCLE OPERATION

BACKGROUND OF THE DISCLOSURE

The present disclosure relates to high intensity discharge (HID) lamps and lighting systems and particularly relates to such systems employing ceramic metal halide lamps wherein an instant start hot re-strike of the lamp is desired. Examples of such devices, particularly a lamp socket for such lamps with an integrated igniter for use with a separate transformer and circuit components, for providing instant start hot re-strike of the lamp at relatively low ignition voltages is described in co-pending application Ser. No. 12/166,548, filed Jul. 2, 2008, entitled "IGNITER INTEGRATED LAMP SOCKET FOR HOT RE-STRIKE OF HIGH. INTENSITY DISCHARGE LAMP" assigned to the assignee of the present application and U.S. application Ser. No. 12/166,532, filed Jul. 2, 2008, now U.S. Patent Publication 2010/0001656, dated Jan. 7, 2010, entitled "A LOW IGNITION VOLTAGE INSTANT START LIGHTING SYSTEM" and assigned to the assignee of the present application.

In the aforesaid HID lamp systems, the lamp and igniter circuitry, including the transformer, have been incorporated in the lamp socket base as an integrated unit which provides hot re-strike and instant ON capabilities for the lamp prior to cooling by providing a relatively high frequency, relatively low voltage, ignition pulse to the lamp and particularly pulses of less than 25 kilovolts. The aforesaid lamp and socket base arrangement has been found particularly suitable for automotive applications. In such applications, the ballast circuitry remains separate and thus requires high voltage cables for interconnection to the lamp base. Although this arrangement may be satisfactory for dedicated system installations such as those provided in automotive applications, it has not been found suitable for replacement of existing lamps in stationary applications and particularly for incandescent, compact fluorescent (CFL), or halogen lamps having a standard screw in base.

HID lighting systems are attractive because they provide intense illumination with substantially less power input than corresponding incandescent, compact fluorescent (CFL), or halogen lamps and thus it has been desired to provide a way or means of replacing existing incandescent, compact fluorescent (CFL), or halogen lamp bulbs with HID lamps. However, the complexity of the circuit componentry required for HID lamps in addition to the problems encountered with hot re-strike of the discharge lamps, have prevented them from achieving wide-spread usage as replacements for incandescent, compact fluorescent (CFL), or halogen lamps.

SUMMARY OF THE DISCLOSURE

The present disclosure describes an HID lighting assembly which enables replacement of incandescent, compact fluorescent (CFL), or halogen lamps either of the screw in base variety, or lamp fixtures of the type intended for attachment to an electrical receptacle box such as a wall or ceiling receptacle where the lighting fixture serves as a cover for the receptacle box and is wired directly thereto. The system of the present disclosure has a lamp housing which in one version includes lamp driver circuitry sometimes referred to as a ballast, the instant ON igniter circuitry, a heat shield for mounting the lamp and typically a reflector and a cover which may include a lens for directing the light emitted from the HID lamp. If desired, sensors may be integrated with the housing as, for example, motion, photoelectric, infrared or acoustic sensors for controlling the ON/OFF cycle. The housing has a screw in base for existing incandescent, compact fluorescent (CFL), or halogen lamp sockets. In another version, intended for direct wiring over an electrical receptacle box, the housing has a mounting plate which serves as the cover for an open electrical receptacle box. In both versions, a lamp base can be provided on the lamp and is releasably connected to a lamp socket attached to the pulse generator or instant "ON" igniter circuitry. This lamp is readily replaceable by removal from the socket and the associated circuitry is fixed to the receptacle box.

BRIEF DESCRIPTION OF THE DRAWINGS

FIG. 7 is a view of a non-replaceable lamp with electrical leads for connection; and.

DETAILED DESCRIPTION OF THE PREFERRED EMBODIMENTS

Figure 1:
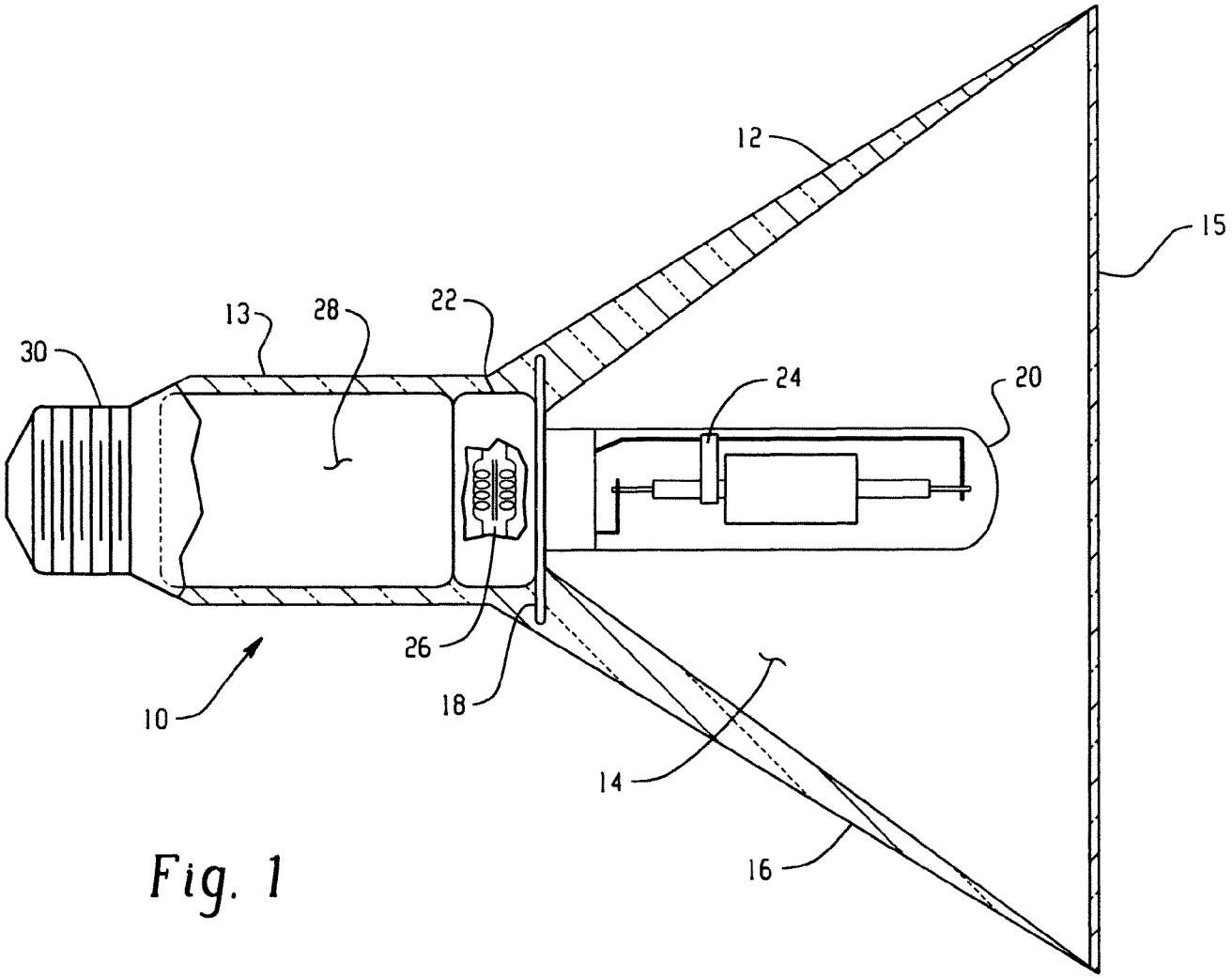
FIG. 1 is a cross-section of an exemplary HID lamp assembly having a threaded base for direct replacement of screw in type incandescent, compact fluorescent (CFL), or halogen bulbs and includes a reflector.

Referring to FIG. 1, an exemplary version of a lamp assembly in accordance with the present disclosure is indicated generally at 10 and has a housing indicated generally at 12 which has a lamp cavity 14 which is opened at the diverging end 16 of the housing with a cover 15; and the end opposite the open end 16 is closed by a heat shield 18 which blocks the heat generated by HID lamp 20 and reflects the light back to the cavity 14. The HID lamp 20 may include a starting aid such as a metal strip 24 to shorten the discharge path between the electrodes of the lamp. An instant "ON" igniter or pulse generator 22 is adjacent to the side of the heat shield opposite lamp 20, and the electrical leads 220, 222 (see FIG. 7) from the HID lamp 20 are connected to the igniter or pulse generator 22.

The igniter 22 includes circuitry which may include a transformer 26 or alternatively a resonant circuit.

Attached to the end of the igniter 22 is the ballast or lamp driver circuitry 28. It will be understood that the driver circuitry and instant ON igniter 22 may be of the high frequency, relatively reduced high voltage circuitry as described in the aforesaid patent applications incorporated herein by reference.

The housing 12 has a reduced diameter portion 13 the distal end of which is configured for threaded engagement with existing incandescent, compact fluorescent (CFL), or halogen lamp sockets as denoted by reference numeral 30; and, the lamp assembly 10 may directly replace an existing incandescent, compact fluorescent (CFL), or halogen lamp by screw in engagement and requires no additional circuit components or wiring for operation therein. A lamp cover 15 is provided on the housing over cavity 14.

Figure 2:
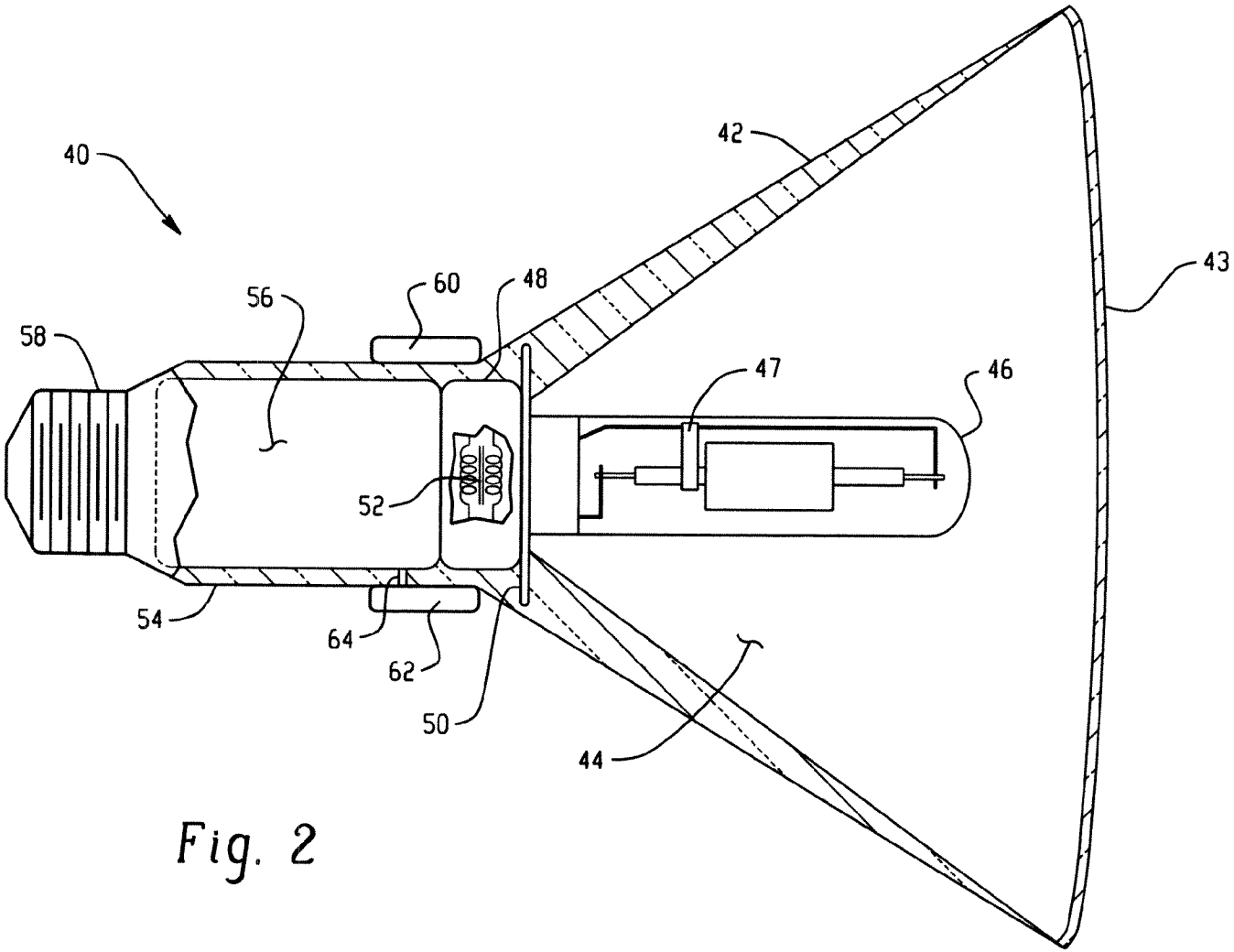
FIG. 2 is a view similar to FIG. 1 of an exemplary HID lamp assembly including sensors mounted directly on the housing.

Referring to FIG. 2, another exemplary version of an HID lamp assembly according to the present disclosure is indicated generally at 40 and has a housing 42 defining a cavity 44 which is open at one end thereof and to which is inserted an HID lamp 46, secured in the housing and isolated from the lamp by a heat shield 50. The lamp 46 also has electrical leads 220, 222 (see FIG. 7) extending through heat shield 50.

An instant ON igniter circuit or pulse generator 48 may include a transformer 52 or alternatively a resonant circuit. In the version 40 of the lamp assembly, the housing 42 has a reduced diameter portion 54 which houses and includes a ballast or lamp driver circuitry indicated generally at 56 and has the end of the portion 54 closed and provided with threads 58 which are configured for direct engagement with existing incandescent, compact fluorescent (CFL), or halogen lamp sockets. ON/OFF controlling sensors 60, 62 are disposed on the outer surface of the reduced diameter portion 54 in the region of the igniter ON circuitry; and, the sensors are connected by suitable electrical leads (not shown) through an aperture 64 formed in the reduced diameter portion 54 of the housing. The sensors 60, 62 may be of any suitable type as, for example, photoelectric, acoustic, motion detecting or infrared. Depending on the application, the sensor can be located in other positions of the lamp housing 42. The inner surface of the cavity 44 may be coated with suitable reflective material; and, the portion of the housing forming cavity 44 may be so configured as to direct or focus the light from the HID lamp 46 into parallel beams or other pattern arrangement as desired. A lamp cover 43 is provided over cavity 44 and a metal strip 47 is provided as a starting aid disposed to shorten the discharge path.

Figure 3:
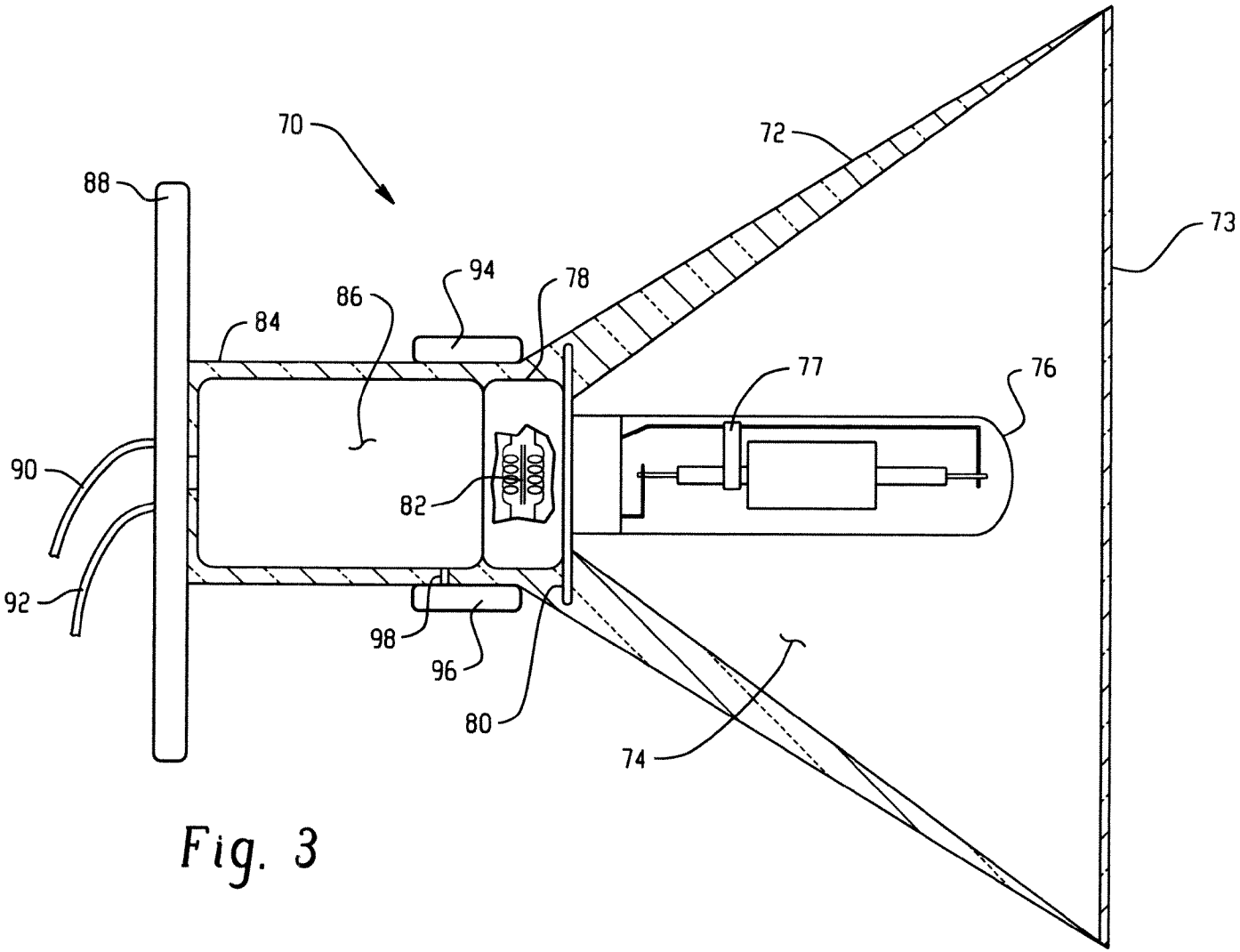
FIG. 3 is a cross-section of another version of an exemplary HID lamp assembly including ON/OFF sensors mounted thereon and with a mounting plate adapted for mounting over an open receptacle box.

Referring to FIG. 3, another exemplary version of the lamp assembly of the present invention is indicated generally at 70 and has a housing 72 with an open end forming a cavity 74 which has received therein an HID lamp 76 which may have a starting aid such as metal strip 77 disposed to shorten the discharge path. A suitable heat shield 80 is disposed in the housing and electrical leads 220, 222 (see FIG. 7) from the lamp extend through the heat shield and connect to an instant "ON" igniter or pulse generator 78 which may include a transformer 82 or alternatively a resonant circuit. The housing 72 includes a reduced diameter portion 84 which has received therein the ballast or lamp driver circuitry 86; and, the reduced diameter portion 84 of the housing includes a mounting plate 88 which is adapted for mounting over the open surface of an electrical receptacle box for direct wiring therein by leads 90, 92 connected through plate 88 to the driver circuitry 86.

The HID lamp assembly 70 of FIG. 3 includes ON/OFF controlling sensors 94, 96 disposed on the reduced diameter portion 84 of the housing and connected to the ballast circuitry 86 by suitable leads (not shown) through an aperture 98 provided in the housing. The sensors 94, 96 may be of any desired type, as for example, photoelectric sensors, motion sensors or acoustical sensing devices or infrared sensing units. Depending on the application, the sensor can be located in other positions of the lamp housing 72 or mounting plate 88. A lamp cover 73 is provided over cavity 74.

Figure 4:
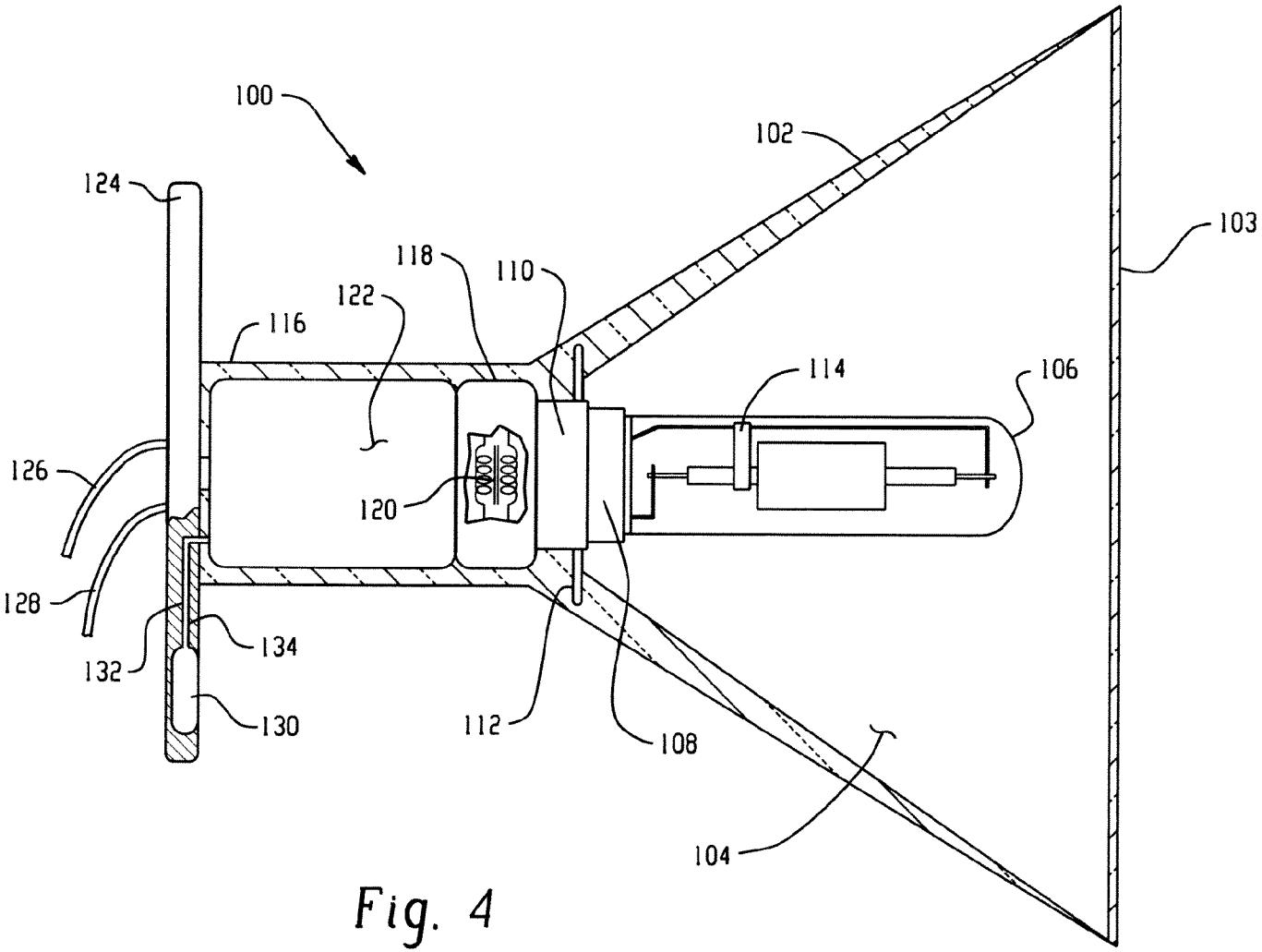
FIG. 4 is a view of an exemplary HID lamp assembly with a socket and removable lamp for mounting on an open receptacle box.

Referring to FIG. 4, another exemplary version of the HID lamp assembly of the present disclosure is indicated generally at 100 and has a housing 102 open at one end and forming a lamp receiving cavity 104 into which is received an HID lamp 106 having a base 108 formed thereon which has suitable connectors 224, 226 (see FIG. 8) extending there from which engage a lamp socket 110 which is mounted on the housing 102 and isolated from the lamp radiation by a heat shield 112. The lamp 106 may include a starting aid such as a metal strip 114 providing a tap to shorten the discharge path. The lamp base 108 is formed as a one piece member with lamp 106 and the base has pins 224, 226 (see FIG. 8) which engage socket 110 in plug-in connection to facilitate ready removal of the lamp for replacement.

Housing 102 has a reduced diameter portion 116 which has mounted therein an instant "ON" igniter circuitry or pulse generator 118 which includes a transformer 120 the output of which is internally connected to the socket 110 by suitable leads (not shown). Although a circuit employing a transformer has been found satisfactory for the pulse generator, other techniques may be employed, as, for example a resonant circuit.

The reduced diameter portion 116 of housing 102 includes a ballast or lamp driver circuitry 122 disposed therein and operatively connected to the igniter on circuitry 118. The end of the reduced diameter 116 of housing 102 is closed and has a mounting plate 124 attached thereto which is adapted for mounting over the open end of an electrical receptacle box for direct wiring thereto by suitable leads 126, 128 connected through the plate to the driver circuitry 122. The mounting plate 124 may include a sensor 130 connected by internal leads 132, 134 to the ballast 122 for controlling the ON/OFF cycles or dimming of the lamp. The sensor 130 may be of any desired type, as for example, an infrared sensor, an acoustic sensor, photoelectric sensor or a motion detecting sensor. Depending on the application, the sensor can be located in other positions of the mounting plate 124 or lamp housing 102. A lamp cover 103 is provided over cavity 104. Similar to the screw in type system in FIG. 2, the replaceable HID lamp system shown in FIG. 4 can have the screw in type lamp base to fit directly into existing incandescent, compact fluorescent (CFL), or halogen lamp sockets (not shown in drawing).

Figure 5:
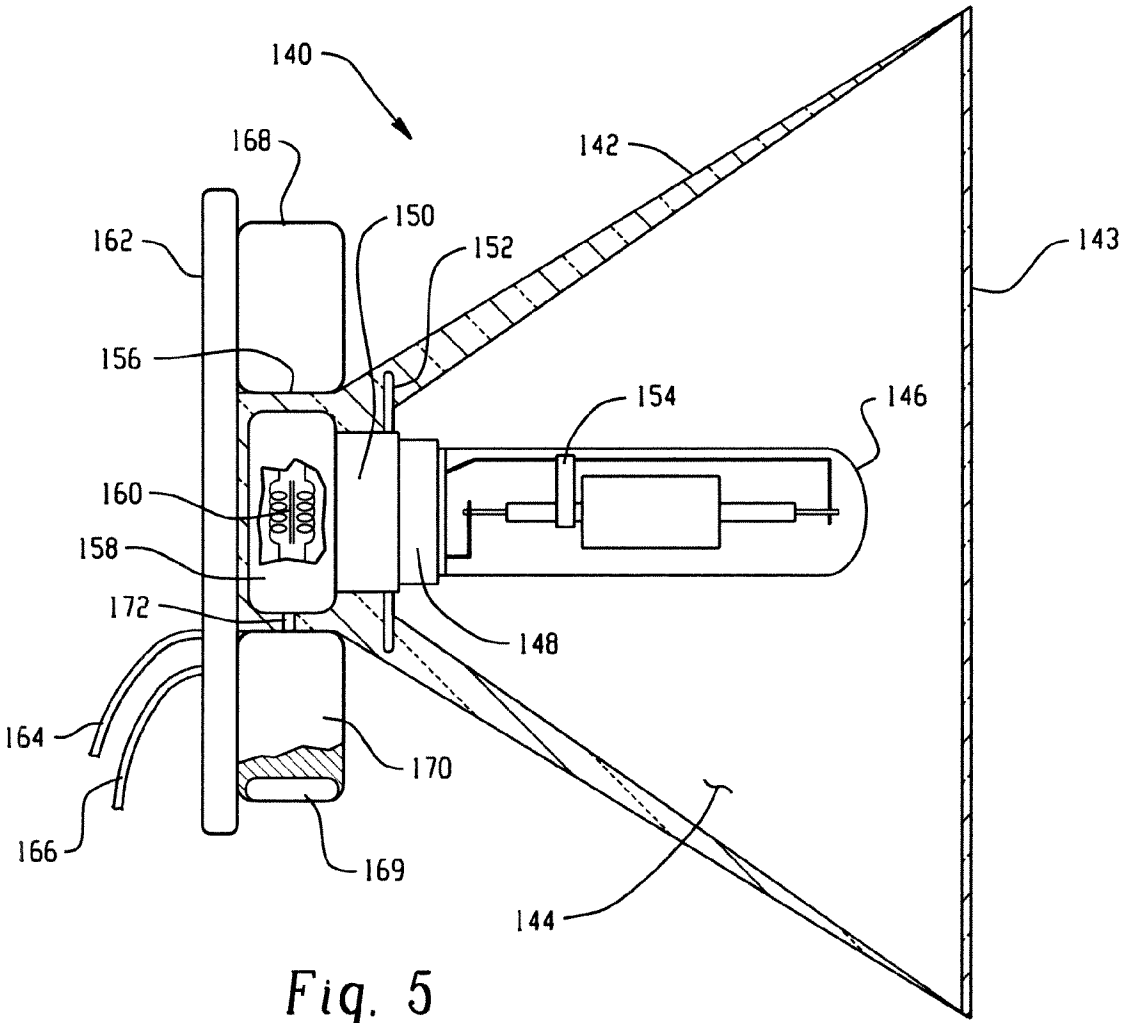
FIG. 5 is a view of another version of an exemplary HID lamp fixture assembly adapted for mounting over an open receptacle box having the lamp driver or ballast mounted directly on the housing externally thereof and including an ON/OFF sensor and the lamp is readily removable from a socket.

Referring to FIG. 5, another exemplary version of the HID lamp assembly of the present disclosure is indicated generally at 140 and includes a housing 142 having an open end and defining therein a cavity 144 into which is received an HID lamp 146 which has a base 148 permanently attached thereto which has pins 224, 226 (see FIG. 8) engaged in a socket 150 provided in the housing. The socket is protected from the rays of the lamp by a suitable heat shield 152. The lamp 146 may include a starting aid such as a metal strip 154 disposed to provide a tap to shorten the discharge path.

The housing has a reduced diameter portion 156 which has disposed therein instant "ON" igniter or pulse generator 158 which may include a suitable transformer 160 or alternatively a resonant circuit connected to provide high voltage to the lamp. The reduced diameter portion 156 of the lamp housing 142 has attached thereto a mounting plate 162 which is adapted for attachment over the open face of an electrical receptacle box and has extending there from suitable electrical leads 164, 166 connected through the plate 162 to driver circuitry 168, 170 for direct wiring into such receptacle box.

In the version 140 shown in FIG. 5, the ballast or lamp driver circuitry 168, 170 is disposed about the reduced diameter portion 156 of the housing as, for example, an annular arrangement or in separate covers 168, 170; and, the ballast circuitry 168, 170 is connected by suitable electrical leads (not shown) through an aperture 172 formed in the wall of the reduced diameter portion 156 of the housing and is connected internally to instant "ON" igniter or pulse generator 158. The version 140 illustrated in FIG. 5 thus provides a readily removable lamp for a permanently mounted fixture assembly, and provides an axially shorter lamp assembly than the version shown in FIG. 4 by virtue of disposing the ballast externally of the lamp housing as for example, concentrically thereabout. A sensor 169 connected by internal leads to the ballast 168, 170 for controlling the ON/OFF cycles or dimming of the lamp. The sensor 169 may be of any desired type, as for example, an infrared sensor, an acoustic sensor, photoelectric sensor or a motion detecting sensor. Depending on the application, the sensor can be located in other positions such as, the mounting plate 162, lamp housing 142, or the outer surface of ballast 168, 170. A lamp cover 143 is provided on cavity 144. Similar to the non replaceable HID lamp system in FIG. 3, the low profile replaceable HID lamp system shown in FIG. 5 can use a non-replaceable HID lamp to further lower the profile by eliminating lamp base 148 and lamp socket 150 (not shown in drawing).

Figure 6:
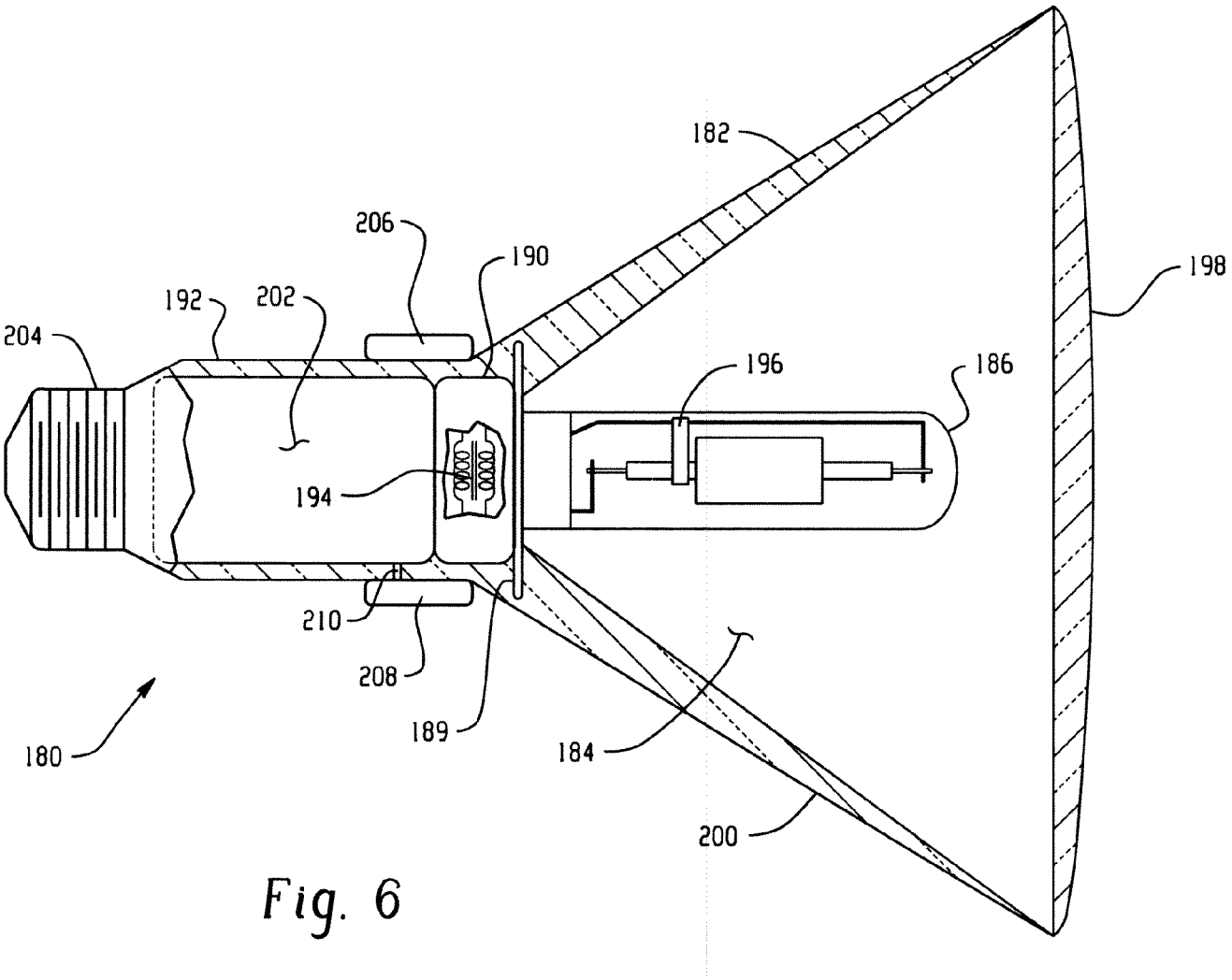
FIG. 6 is a view of another version of an exemplary HID lamp assembly similar to FIG. 1 with a threaded base and a combined lamp cover and lens.

Referring to FIG. 6, another version of the lamp assembly is indicated generally at 180 which is similar to the version 10 of FIG. 1 and has a housing 182 forming a cavity 184 therein into which is received an HID lamp 186 disposed in the housing cavity 184 with unshown electrical leads 220, 222 (see FIG. 7) extending through a heat shield 189 disposed for protecting instant "ON" igniter, or pulse generator 190 which may include a transformer 194 or alternatively a resonant circuit. The lamp 186 includes a metal strip 196 provided therein for providing a shortened discharge path as a starting aid.

The housing 182 has a lamp cover 198 provided over the cavity 184; and, in the exemplary version illustrated in FIG. 6, the lamp cover 198 comprises a lens which may provide for focusing or dispersion of the light rays emanating from the lamp and as reflected from the inner reflecting surface 200 of the housing 182. The reduced diameter portion 192 of the housing 182 also includes ballast or lamp driver circuitry 202. The end of the housing distal from lens 198 comprises the base of the housing and has provided thereon threaded portion 204 which is configured and adapted for engaging existing lamp sockets for screw base incandescent, compact fluorescent (CFL), or halogen bulbs. The reduced diameter portion 192 of the housing has provided thereon sensors 206, 208 which may be connected to the lamp driver circuitry by suitable leads (not shown) through aperture 210 provided through the wall of the reduced diameter portion 192. Sensors 206, 208 may be of the photoelectric, acoustical, infrared or motion detecting variety by way of example. The sensors may be employed to control the ON/OFF cycling or dimming of the lamp. The sensor 206, 208 may be of any desired type, as for example, an infrared sensor, an acoustic sensor, photoelectric sensor or a motion detecting sensor. Depending on the application, the sensor can be located in other position of lamp housing 182.

Figure 7:
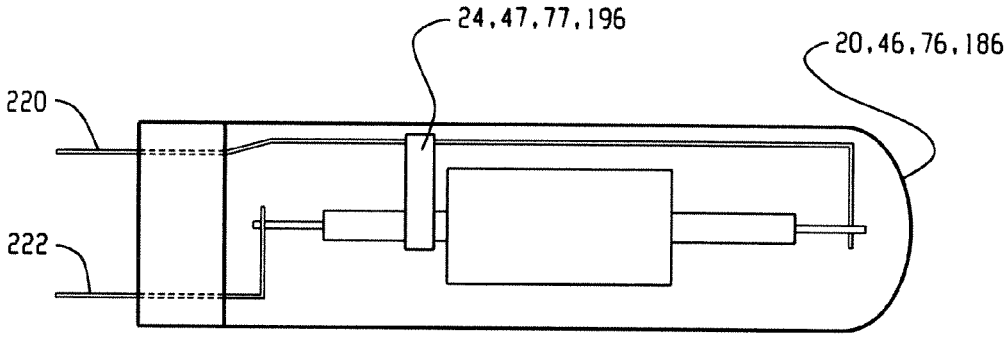

Referring to FIG. 7, the non-replaceable lamp 20, 46, 76, 186 is shown separately with electrical leads 220, 222 extending there from which are adapted for fixed connection into the igniter circuitry 22, 48, 78, 190 of the versions shown respectively in FIGS. 1, 2, 3 and 6.

Figure 8:
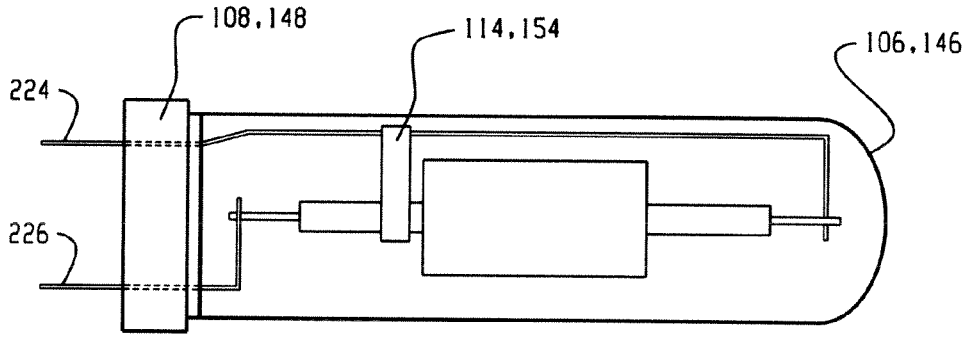
FIG. 8 is a view of a replaceable lamp with base and pins extending there from for plug-in socket connection.

Referring to FIG. 8, the replaceable version of the lamp 106, 146 shown respectively in the versions of FIGS. 4 and 5 is shown separately with integral base 108, 148 and plug in socket connecting pins 224, 226 extending there from, for engaging sockets 110 and 150.

The present disclosure thus describes in one version an HID lamp assembly including an instant "ON" igniter or pulse generator and a lamp driver circuit which may be substituted in an existing screw type lamp socket for a commonly used incandescent, compact fluorescent (CFL), or halogen lamp bulb. Where the HID lamp could be either non replaceable type without lamp socket (see FIG. 7) or replaceable type with a lamp socket (see FIG. 8). Another version is adapted for mounting directly over an open electrical box as is in the case of wall or ceiling mounted light fixtures with an instant ON igniter or pulse generator and lamp driver circuitry. Again the HID lamp could be either non replaceable type without lamp socket (see FIG. 7) or replaceable type with a lamp socket (see FIG. 8). In both versions, sensors may be attached to the housing or mounting plate and connected to the lamp circuit for controlling ON/OFF cycling or dimming. The sensors may be, for example of the photoelectric, acoustic, infrared or motion sensing type. Optionally, the sensors may be disposed remotely and wired separately into the lamp power circuit.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A high intensity discharge (HID) lighting assembly capable of instant ON/OFF cycle (hot restrike) operation comprising:

(a) a housing having disposed therein a high intensity discharge lamp with lamp driver circuitry, an instant "ON" igniter, the igniter including circuitry including a pulse generator operable to provide relatively reduced high voltage pulse of less than 15 kilovolts and frequency in the range of 20-500 Hz to produce light from the lamp; and, (b) the housing including a mounting end configured for one of (a) threaded connection in an existing screw in type socket or (b) mounting directly on an open receptacle.

2. The lamp lighting assembly defined in claim 1, wherein the high intensity discharge lamp is readily removable from the housing.

3. The lamp lighting assembly defined in claim 1, wherein the high intensity discharge lamp is not removable from the housing.

4. The assembly defined in claim 1, further comprising a sensor for controlling ON/OFF cycling.

5. The assembly defined in claim 1, further comprising a sensor for dimming the lamp power.

6. The assembly defined in claim 1, wherein the ballast is disposed annularly about the housing.

7. The assembly defined in claim 1, further comprising a lamp cover including a lens.

8. The assembly defined in claim 1, wherein the instant "ON" igniter comprises a pulse generator and includes a transformer.

9. The assembly defined in claim 2, wherein the housing includes a lamp socket.

10. The assembly defined in claim 2, wherein the lamp includes a plurality of pins engaging the socket.

11. A method of operating a high intensity discharge (HID) lighting system capable of instant ON/OFF (hot restrike) operation comprising:

(a) providing a housing and disposing an HID lamp in the housing;

(b) disposing an instant ON igniter and providing with the igniter circuitry operable for relatively reduced high voltage pulsing of less than 15 kilovolts and frequency in the range of 20-500 Hz in the housing to produce light from the HID lamp and connecting the HID lamp to the igniter;

(c) disposing lamp driver circuitry in the housing and connecting the lamp driver circuitry to the igniter; and, (d) configuring the housing for one of (a) threaded socket engagement or (b) mounting over an open electrical receptacle.

12. The method defined in claim 11, wherein the step of disposing an igniter includes disposing a transformer.

13. The method defined in claim 11, wherein the step of disposing an igniter includes disposing a resonant circuit.

14. The method defined in claim 11, wherein the step of configuring the housing for threaded socket engagement includes forming a threaded end on the housing.

15. The method defined in claim 11, wherein the step of configuring the housing for mounting over an open electrical receptacle includes providing a receptacle mounting plate on the housing.

16. The method defined in claim 11, wherein the step of disposing an HID lamp includes disposing a socket in the housing and engaging the lamp in the socket for ready replacement of the lamp.

17. The method defined in claim 16, wherein the step of engaging the socket includes forming a base on the lamp and providing pins thereon.

18. The method defined in claim 11, wherein the step of providing a housing includes disposing a control sensor on the housing end connecting the sensor to the lamp driver circuitry.

19. The method defined in claim 18, wherein the step of disposing a control sensor includes disposing one of an acoustical, an infrared, a motion detecting and photoelectric sensor.

20. The method defined in claim 11, wherein the step of disposing lamp driver circuitry includes disposing lamp driver circuitry annularly about a reduced diameter portion of the housing.

21. The method defined in claim 11, wherein the step of configuring the housing for mounting on an open electrical receptacle includes providing a mounting plate and disposing a control sensor on the mounting plate.

22. The method defined in claim 11, wherein disposing an instant ON igniter and providing includes providing circuitry for relatively reduced high voltage pulsing of about 8-10 kilovolts.

23. The assembly of claim 1, wherein the instant ON igniter includes circuitry providing a relatively reduced high voltage pulse of about 8-10 kilovolts.

24. The assembly of claim 1, wherein the lamp includes a fill gas so that in response to the voltage pulses, the gas fill becomes a plasma that emits light.

* * * * *